US006857521B2

(12) United States Patent
Cantu-Gonzalez

(10) Patent No.: US 6,857,521 B2
(45) Date of Patent: Feb. 22, 2005

(54) CONTAINER AND RETAINING DEVICE FOR PACKAGING AND UNWINDING COILED WELDING WIRE

(75) Inventor: Ricardo Cantu-Gonzalez, Nuevo Leon (MX)

(73) Assignee: Plasticos Y Alambres, S.A., Garcia (MX)

( * ) Notice: Subject to any disclaimer, the term of this patent is extended or adjusted under 35 U.S.C. 154(b) by 209 days.

(21) Appl. No.: 10/195,348

(22) Filed: Jul. 13, 2002

(65) Prior Publication Data

US 2004/0007487 A1 Jan. 15, 2004

(51) Int. Cl.[7] ..... B65D 85/04
(52) U.S. Cl. ..... 206/397; 206/408
(58) Field of Search ..... 206/395, 396, 206/397, 405, 415; 242/125, 129, 422, 422.1, 422.5, 422.6, 422.8, 423.1

(56) References Cited

U.S. PATENT DOCUMENTS

| | | | | | |
|---|---|---|---|---|---|
| 1,952,056 | A | * | 3/1934 | Cook | 206/408 |
| 2,864,565 | A | * | 12/1958 | Whearley | 224/128 |
| 4,869,367 | A | | 9/1989 | Kawasaki et al. | |
| 5,105,943 | A | * | 4/1992 | Lesko et al. | 206/397 |
| 5,277,314 | A | | 1/1994 | Cooper et al. | |
| 5,494,160 | A | * | 2/1996 | Gelmetti | 206/395 |
| 5,690,225 | A | * | 11/1997 | Lutz et al. | 206/416 |
| 5,746,380 | A | | 5/1998 | Chung | |
| 5,758,834 | A | | 6/1998 | Dragoo et al. | |
| 5,819,934 | A | | 10/1998 | Cooper | |
| 5,845,862 | A | * | 12/1998 | Cipriani | 242/423.1 |
| 6,237,768 | B1 | | 5/2001 | Cipriani | |
| 6,481,575 | B2 | * | 11/2002 | Cipriani | 206/408 |
| 6,547,176 | B1 | * | 4/2003 | Blain et al. | 242/423.1 |
| 6,550,708 | B2 | * | 4/2003 | Messier | 242/128 |

FOREIGN PATENT DOCUMENTS

| | | |
|---|---|---|
| JP | 3133579 | 6/1991 |
| JP | 3264169 | 11/1991 |
| WO | WO 98/52844 | 11/1998 |

* cited by examiner

*Primary Examiner*—Shian T. Luong
(74) *Attorney, Agent, or Firm*—Frommer Lawrence & Haug LLP; A. Thomas S. Safford

(57) ABSTRACT

A low-cost totally recyclable container made of corrugated cardboard for packaging a large mass of coiled welding wire is disclosed. The improved container minimizes the costs of packaging and avoids the need of large volumes for transportation and storage of empty containers to and from the welding wire manufacturing plant and at the welding plant. The container in kit form or assembled with or without the wire coil includes a wire retaining device of simple and inexpensive design to press down on the top of the coil of wire when in the container without binding against the inner walls of the container while preventing the wire which is arranged in a multitude of layers of wire loops from tangling during transportation, storage, and unwinding while providing effective means for smooth and uninterrupted payout of welding wire to automatic welding machines. The wire retaining device is secured relative to the inner wall of the container by means of plastic or metallic strips passing through peripheral openings in the retaining device, said strips being fixed to the wall at two vertically spaced points along the height of the welding wire mass. The container is fully recyclable avoiding the environmental impact caused by other packaging materials.

22 Claims, 4 Drawing Sheets

CONTAINER AND RETAINING DEVICE FOR PACKAGING AND UNWINDING COILED WELDING WIRE

RELATED APPLICATION (PROVISIONAL APPLICATION PRIORITY CLAIM)

Benefit is claimed of the prior filing date of provisional application No. 60/353,825, filed Feb. 1, 2002 in accordance with 37 CFR §1.78(a) (4) and 35 USC §120.

FIELD OF THE INVENTION

The invention concerns an improved container and its accessories, particularly adapted for low-cost and efficient packaging, transporting, and unwinding of large quantities of coiled welding wire; having such a design and incorporating such materials that make it ecologically desirable and easily recyclable, thereby overcoming many disadvantages of prior art containers.

BACKGROUND OF THE INVENTION

Modern automatic welding machines utilize welding wire which should be fed continuously at high velocities, uniformly, without undesirable twists and with a minimum of interruptions. It is therefore desirable to package the welding wire in coils of the longest length practically possible for its efficient and economical handling and to minimize the number of times the empty containers are replaced by new ones for feeding the welding machines.

The wire is packaged by special winding machines which continuously coil the wire in the annular space within the container formed typically between a central core member and the container wall. Usually, the container is provided with a variety of devices for retaining the wire in its coiled form and to avoid its tangling during transportation and particularly during unwinding.

It is also desirable to minimize the overall costs involved in the packaging and handling of the welding wire from the wire manufacturing plant to the plant of ultimate usage. The containers currently used for packaging welding wire are cylindrical drums made from any of a variety of materials, for example, reinforced composites or other thick and strong materials with several metallic rings at their upper and lower lids. These are designed to withstand rough handling during transport. These drum-type containers are expensive due to the high cost of materials and their special fabrication. After the welding wire is consumed by the welding machines, usually in plants remote from the place where the welding wire is manufactured, then the empty containers must be temporarily stored, occupying excessive space until they can be properly disposed of. Sometimes, the empty drums may be transported back to the welding wire manufacturing plant at a high cost because of the volume they occupy. Alternatively, it is not easy to dispose of these containers, because they can not easily be destroyed and because the materials they are made of are not readily recyclable.

An example of the containers currently in use is shown in U.S. Pat. No. 5,105,943 to Lesko et al. This patent describes a cylindrical container (a drum) made of thick paperboard which includes a tubular core co-axially extending in the drum thus leaving an annular space where the welding wire is wound in the form of a multitude of layers of looped wire. A looped strap is fixed at the bottom of the tubular core and one end of an elastic cord is fixed to said strap and its other end to a diametrically extending bar which presses downwardly a top disc, which can be formed by two semicircular sections, thus maintaining the wire mass in place while being transported.

The Lesko container, although offering the advantage of utilizing a low-cost material, does not offer a good mechanical resistance to forces applied to its circular wall 12, therefore requiring an excessive amount of cardboard material for its fabrication. Also, it presents a drawback in that the retainer disk 42 can not be adjusted to variable heights of the wire mass, because the core 28 limits its action. Therefore, the container must always be filled with welding wire to a height higher than said core 28. The retainer disk 42 must be removed for unwinding the wire.

An improvement to the device for preventing the welding wire from tangling is described in U.S. Pat. No. 5,746,380 to Chung. Chung discloses a combination of a number of elements including bead packages 4' which are distributed over the top layers of wire and two rings 5 and 6 which are pressed by elastic bands 7 and 7' against the wire coil 8. Prior to drawing the wire out of the container, the pressing short pipes 3 and buffer rings 5 and 6 are removed and some bead packages 4' are torn, and the beads 4 are scattered over the coiled welding wire to prevent tangling. The wire 9 then goes smoothly through the beads 4 without tangling. When the wire is to be fed to automatic welding machines, all these elements must be removed and recovered for further use in other containers. Chung also shows a guiding cover 1' of conical form which is fitted over the top of the container having a wire guiding tube 11 through which the wire 9 is passed for its orderly unwinding. Scattering of the beads 4 over the wire 9 is impractical, since they have to be repackaged for further use, causing unnecessary material costs, increased labor time, and added weight with resulting increased shipping cost for the heavier wire package.

U.S. Pat. No. 4,869,367 to Kawasaki et al. proposes to eliminate the internal tubular core 2 of the prior art; to use a container of steel and also a different design for a retaining and guiding member 4 which descends by gravity as the wire is withdrawn from the container. The retaining member 4 has a ring form having a circular hole 17 at its center to permit withdrawal of wire 3 therethrough. The retaining member 4 has several resilient members 5 (FIG. 4 embodiment) for contact with the inner wall 1 of the container to prevent the wire from passing through the space close to the inner wall of the container. The resilient members 120 (FIG. 6 embodiment) must be flexible enough to not cause excessive drag force while moving in contact with the wall 1 and at the same time be rigid enough to present an effective resistance against the wire if it tends to pass through the area of contact of said resilient members. The retaining member of Kawasaki adds to the cost of the packaging and transport because of the special type of materials used; and it may not provide the desired effect, because it may easily assume a non-horizontal position due to non-uniform friction between said resilient members 120 and the wall of the container.

An improvement to the cylindrical container shown in the above patent is described in U.S. Pat. No. 5,819,934 to Cooper. Cooper shows a drum-type container A having a central tubular core 30 and a simplified way of forming a loop 80, 200, 220, 250 or 266 at the bottom of the core 30 in order to secure by means of a hook 76 one end of an elastic band 72 that pulls down on a bar 70 and thereby on an annular disk member 52, which in turn presses on and retains the wire W in the space 40 during shipping and storage of the container. The container of Cooper however presents the same drawbacks as Lesko, described above.

In the interest of providing an effective device for the smooth withdrawal of welding wire, another proposal for such a device illustrated as used in cylindrical containers is described in U.S. Pat. No. 5,277,314 to Cooper et al. This patent discloses a retainer ring 110 for a cylindrical container of welding wire comprising a generally flat outer portion with an outer periphery fitting into the wall of the container, and a bell-mouth portion though which the wire is payed out. The retaining ring of Cooper is expensive because of its special design.

A further example of a cylindrical container for welding wire is described in U.S. Pat. No. 5,758,834 to Dragoo et al. Dragoo shows a cylindrical wire container 10 including a wire control apparatus 100 mounted at the top of an inner tubular core 25 which comprises a ring 105 and is provided with a plurality of fingers 140 mounted on said ring. This structure differs from the typical prior art in that the welding wire is payed out past the outer periphery of the ring 105, rather than through the ring's center hole. A plurality of tie-down wires 120 serve as upwardly sloping diverter members and also prevent the welding wire from entering into the space between the ring and the core. The fingers extend into contact with the wall of the container to insure that the welding wire is forced against the inner surface of the container as the welding wire is withdrawn therepast. The stiffness of the fingers is such that the wire cannot by itself uncoil past the fingers and exit the drum, however at the same time the fingers must not be so stiff as to impede purposeful withdrawal of the wire past such fingers (in other words, the resistance to wire movement from the container past the fingers should not adversely affect the wire feeding process).

Other types or wire retaining devices are shown in Japanese Patent Publications JP3133579 and JP3264169. These devices have in common the provision of a plurality of flexible extending members which contact either the inner wall of the container or the outer wall of the core, respectively, and past which flexible extending members the wire is withdrawn. The device in JP3264169 is similar to Dragoo.

A cardboard container having an octagonal section is described in the International Patent Application No. WO 98/52844. This patent application shows a container 1 comprising a box-like body 4 with a wire retaining device 17 to prevent the wire from tangling and a wire conduit device 10 to guide the wire out from the container during the unwinding. The retainer device 17 is made of three rings 18, 19 and 20 joined together by bridging elements 22 which have radial projections 23 dimensioned to be in solid continuous contact with the inner surface of the container wall to prevent the wire from passing through the space near the wall. The wire retaining device of this patent has to be fabricated to exact dimensions in order to fit in the container and achieve its purpose. A guide member 10 is positioned at the top of the container below the cover 1 to guide the welding wire but has the disadvantage that there is not sufficient space for the wire to rapidly unwind. This restriction may cause tangling of the wire inside the container. Since the retainer device 17 is light weight, the friction between projections 23 of the retainer device 17 with the wall of the container results in the descent of the retainer being not as effective as would be expected (in spite of the elastic pull down 30), because small irregularities in the cardboard walls which can impede and even cant the downward travel of the device vertically and uniformly as the wire is consumed. The guiding member 10 has the drawback that it does not at least initially provide sufficient space between the top of the wire coil and the guide member for the wire to spring up naturally at the beginning of the unwinding and thus instead fosters its tangling.

Another cardboard container is described in U.S. Pat. No. 6,237,768 to Cipriani. The container of Cipriani is also made of cardboard but is formed by two box-like parts, an external cubic box 1 intended to provide strength to the assembly and an inner octagonal box 2. The container also includes plastic bags 4 to enclose and seal the welding wire and protect it from air and humidity, as well as a polygonal section core 2*b*. Although the container of Cipriani has the advantage of being mechanically stronger, it is much more elaborate and expensive than other containers and the present invention.

During transportation and storage of the welding wire, Cipriani utilizes a pressure bar 10 forced downwardly by an elastic strap 9 attached to a hook 7 fixed at the bottom of the container. This bar 10 presses on a pair of rubber members resting between the bar 10 and a ring 12 placed on top of the wire coil. During unwinding of the welding wire, Cipriani proposes to use a guide member 8 having a square base which fits on the cubic box 1. The guide member 8 has a general conical shape and ends in a top flat portion with a central hole 8*c* through which the wire is extracted from the container. The container of Cipriani comprises a considerable number of parts more than the parts of the present invention, thus adding to the cost and weight of Cipriani's container.

The need therefore exists for a container effective for handling increased volumes of welding wire at such a low cost that it can be readily and also ecologically disposed of after the wire has been transported and withdrawn from the container at the automatic welding machine. The present invention provides such type of container offering a number of advantages over the containers of the prior art and at the same time being effective in the smooth feeding of such wire according to the demanding standards of the automatic welding processes.

SUMMARY OF THE INVENTION

In the present invention, the body of the container is made of an inexpensive material, such as normal packaging corrugated cardboard, and low-grade wood for a pallet-type base when needed, in order to minimize the costs of packaging and provide the advantage of disposing of the container at the location where the welding wire is consumed in an easy and ecologically accepted manner, thus totally avoiding the transportation of empty containers back to the wire manufacturing plant, which in some cases might be necessary due to the high cost of such containers.

The body of the container is shaped to have a polygonal section, preferably an octagonal section. This form provides mechanical resistance minimizing deformation of the container by movement during transportation, The container is manufactured and shipped to the welding wire plant in separate parts to facilitate its shipping. It is then assembled to its final form at the wire plant. In this way, the containers can be stored folded flat, both in the wire manufacturing plants and in the welding plants, in small spaces instead of having large volumes occupied by empty cylindrical containers made of hard materials. The body of the container may be made of at least two layers of corrugated cardboard each with the corrugated vanes oriented in a different direction than the orientation of the other, thus increasing the mechanical resistance of the container.

A wire retaining device is provided and positioned on the top surface of the wire mass. The retaining device is made of low-cost wire rod in the form of a ring, of such a diameter so as to fit and rest on top of the welding wire coil and encircle a tubular core of the container, and having at least one opening formed by a portion of wire rod welded or otherwise fixed to said ring. The retaining device descends by gravity over the top layer of wire as the welding wire is withdrawn from the container always maintaining the restriction on the wire that it can be withdrawn only through the central opening of the retaining ring. At least one strip of plastic or metallic material, for example flexible plastic packing strip or flexible metallic strip or wire, is caused to pass through said opening in the periphery of the retaining ring, to assure that the retaining ring is always in its position over the top layer of welding wire and also to prevent said welding wire from unwinding from the outer periphery of the wire mass because one end of said strip is fixed to an upper point close to the top of the container and its other end is fixed to a lower point near the bottom of the container. In this way the strip in cooperation with the retaining ring prevents the welding wire from being withdrawn through any area other than the central hole of said retaining ring.

It is therefore an object of the present invention to provide a container for coils of welding wire made of inexpensive packaging cardboard, and having a minimum number of parts and simplified design, which lowers the costs of packaging and handling of said welding wire.

It is another object of the present invention to provide an effective and simple wire retaining device to prevent said wire from tangling while said wire is transported, stored and fed out to welding machines and consumed by automatic welding machines, which retaining device can be used in the container of the invention and also in the containers of the prior art.

It is a further object of the invention to provide a low-cost container for welding wire which can be easily produced and disposed of after consumption of the welding wire, because it is made of inexpensive materials and is totally recyclable.

Other objects of the invention will be in part evident and in part will be pointed out hereinafter.

DETAILED DESCRIPTION OF THE INVENTION

Figure 1:
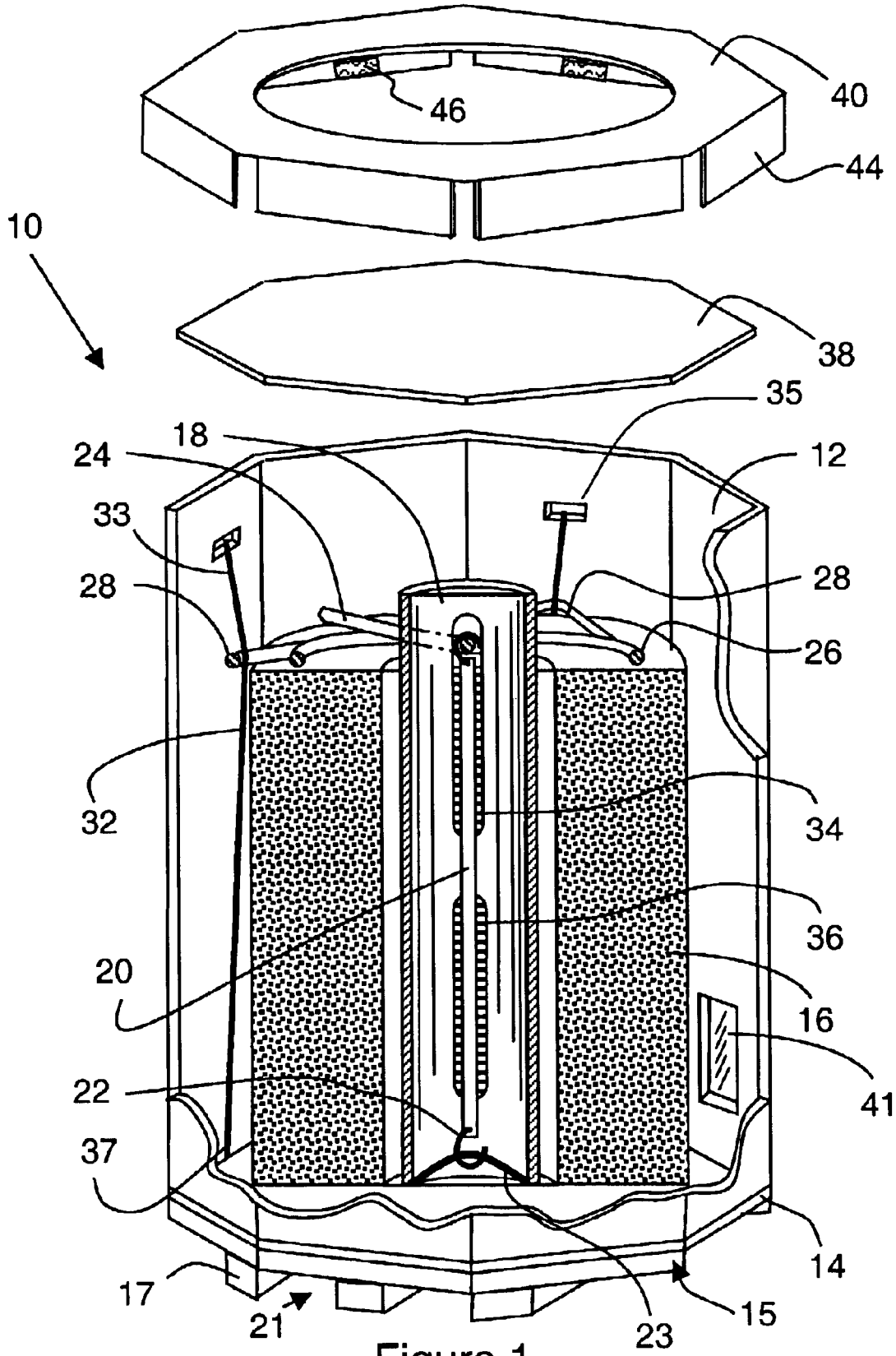
FIG. 1 shows a diagrammatic perspective side view of the container of the invention, partially vertically sectioned, illustrating the general arrangement of the assembly for transportation and storage.
Figure 2:
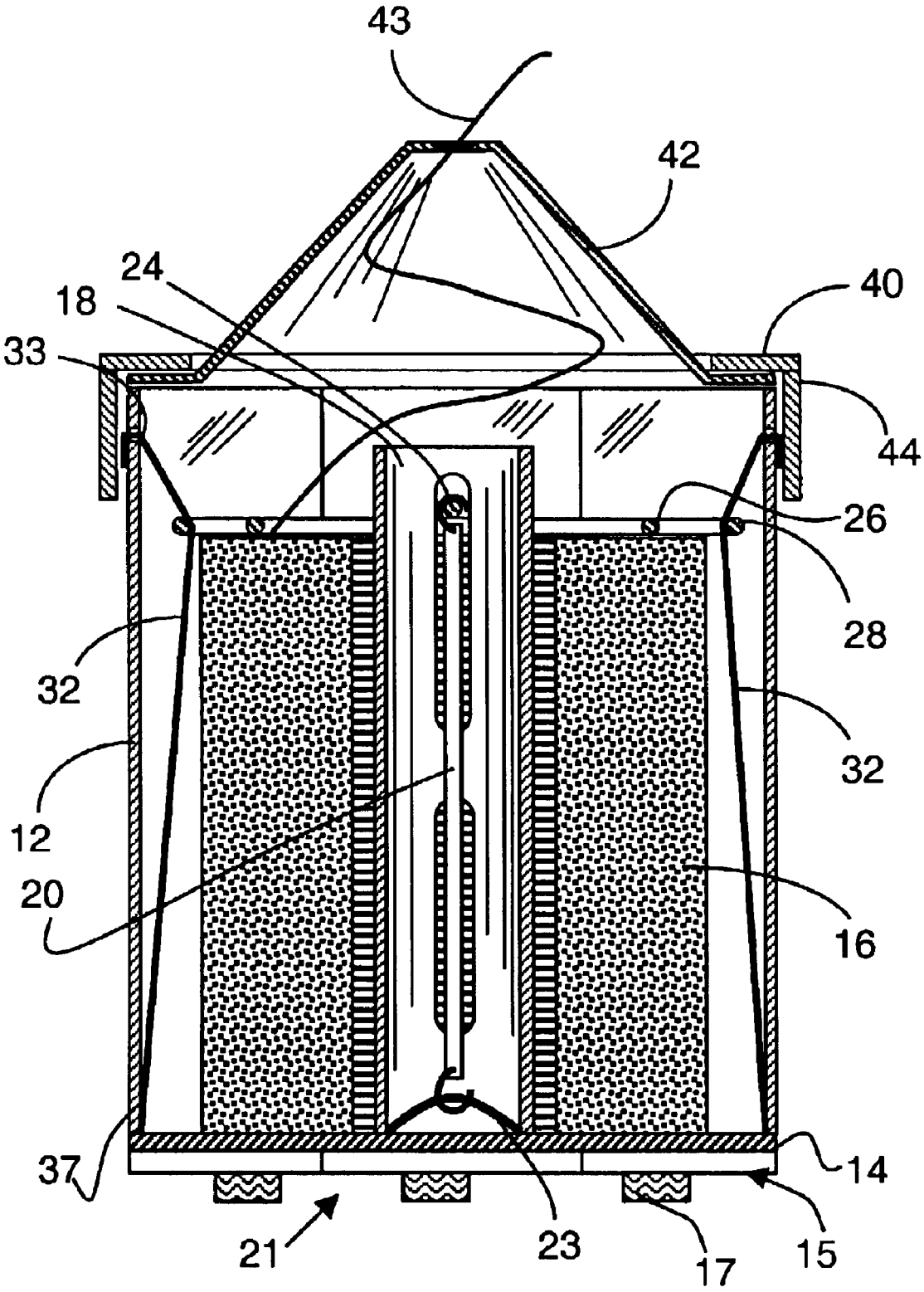
FIG. 2 shows a diagrammatic side view in vertical cross section of the container as assembled with the guide member for withdrawal of the welding wire by welding machines.
Figure 3:
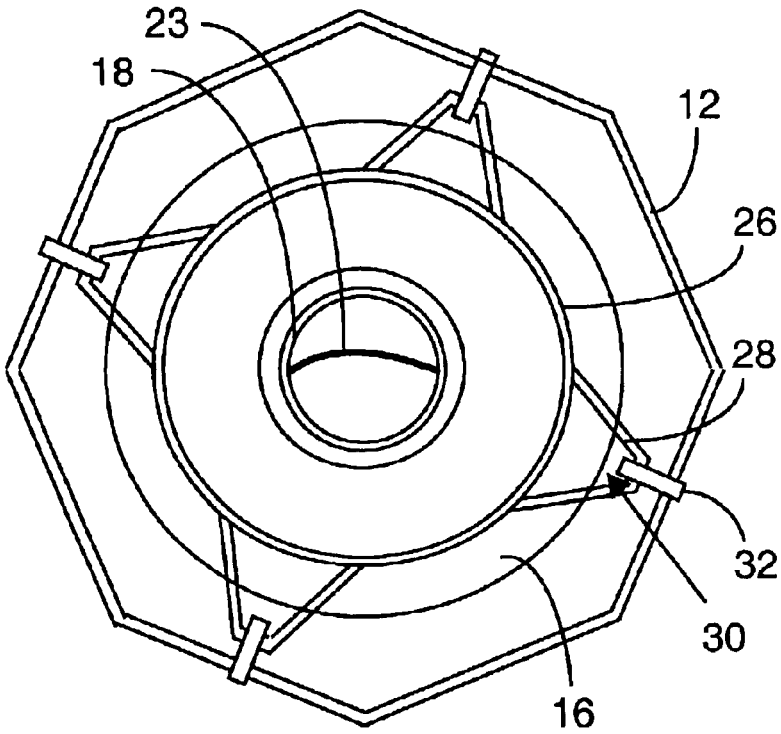
FIG. 3 shows a diagrammatic plan view of the container showing the position and arrangement of the wire retaining device.
Figure 4:
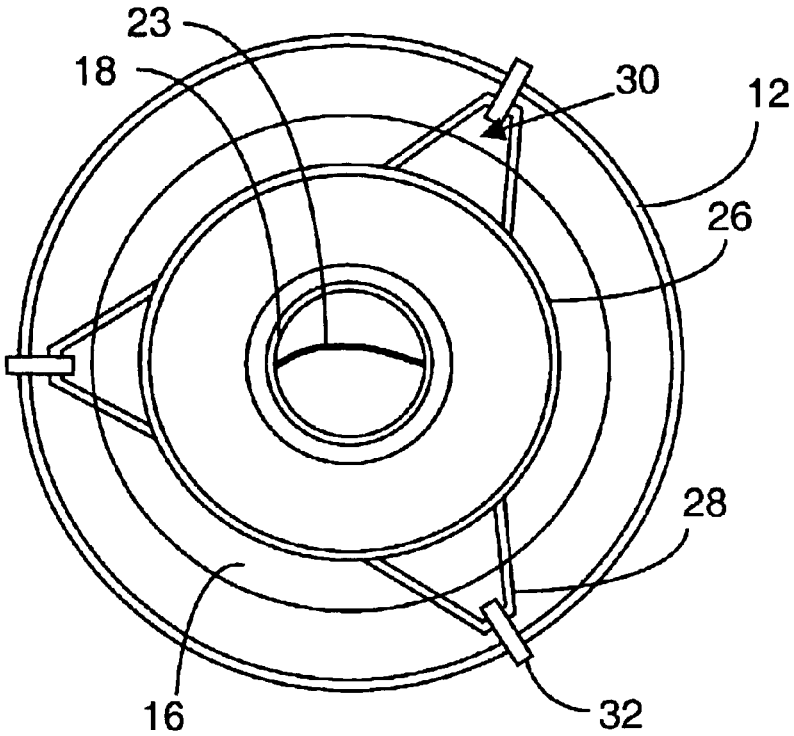
FIG. 4 shows a diagrammatic plan view of a second embodiment of the retaining device according to the invention as used in a cylindrical container typically currently employed in the art.
Figure 5:
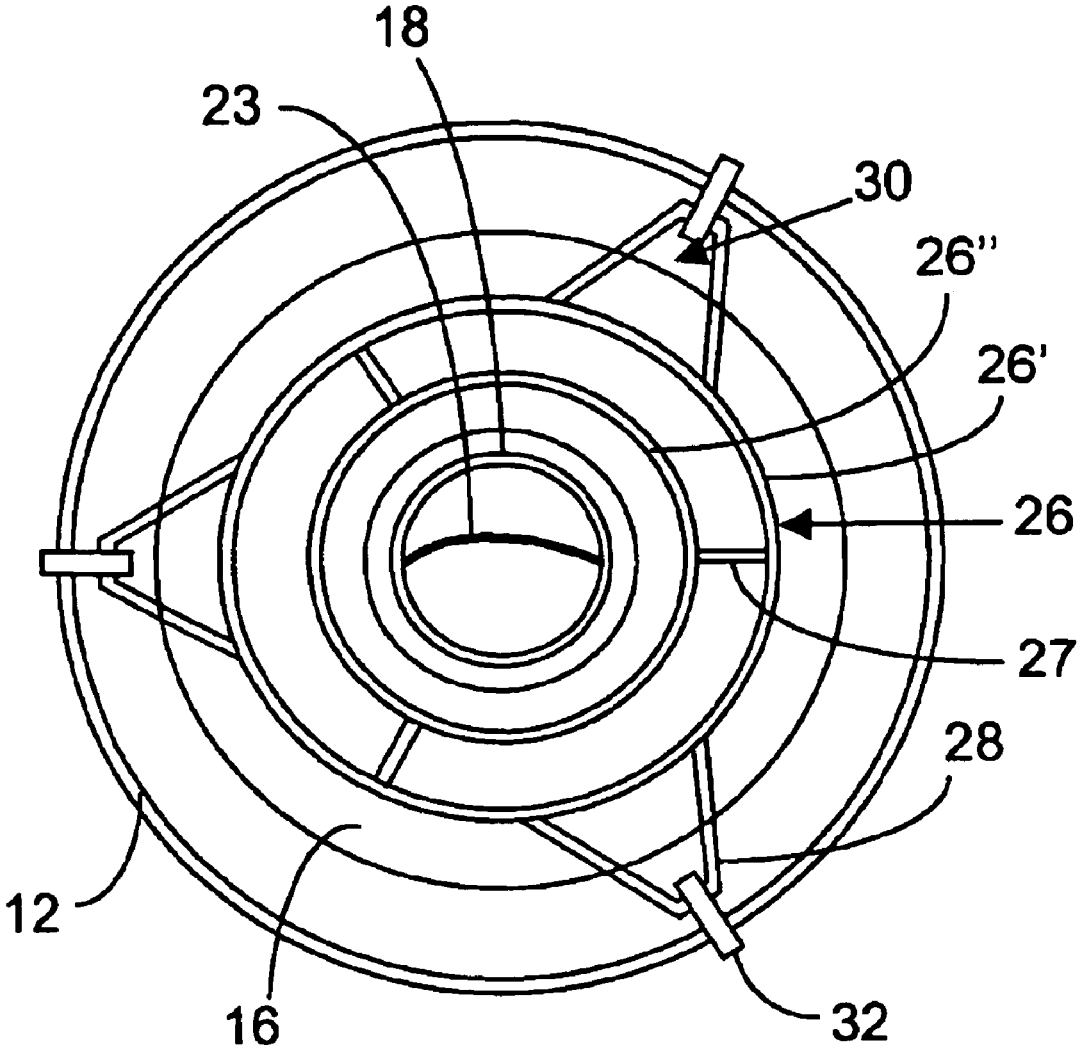
FIG. 5 shows a diagrammatic plan view of a third embodiment of the retaining device according to the invention as used in a cylindrical container typically currently employed in the art.

A preferred embodiment of the invention is described below with reference to FIGS. 1 to 4, wherein the numeral 10 generally designates a container made of corrugated cardboard of a polygonal section, which in the illustrated preferred embodiment has an octagonal cross section, comprising a vertical wall 12. Being made of corrugated cardboard, the container is of low cost, which can be produced and disposed of easily. The materials forming the container are all recyclable and free of any environmental problems. The containers are usually fabricated in paper and packaging plants remote from the welding wire manufacturing facilities. The polygonal shape allows the containers to be shipped to the welding wire manufacturing plants in parts and flat folded to minimize their volume and consequently the transportation cost. If the containers are to withstand extended open outdoor or humid conditions, the wall 12 may be covered, for example with a water-based water-repellent resin, in order to protect the welding wire from excessive humidity. This also adds some strength to said wall.

A first flat base 14 made also of corrugated cardboard is glued to the vertical wall 12 by means of flaps (not shown for simplicity of the drawings) in a manner known in the art. Thus joined, the base 14 and the wall 12 together form the body of the container 10 for receiving and enclosing the wire coil 16. The flat base 14 is then attached to a second base 15, which includes lower spaced elongated members 17 that together form a pallet-like structure. Elements 15 and 17 are made of low-grade wood or preferably of thick cardboard and adapted to have bottom spaces 21 of a size to accommodate handling by standard fork lift truck in a manner known in the art.

A tubular core 18 of circular or polygonal section, made of the same cardboard material is glued to the base 14 to define an annular space between said core and the wall 12 of the container, where the welding wire coil 16 is packaged in the form of layers of superposed loops of wire in order that the wire does not tangle and can be withdrawn smoothly and without interruptions by automatic welding machines. The welding wire coil 16 is deposited by a special wire packing machine so that when it is continuously directed to the welding automatic machines the wire is in a non-twisted, non-distorted, non-canted condition so that the welding operation is performed uniformly over long periods of time without intervention or inspection of the welding machine operators.

The spacing of the coil 16 from the inner walls 12 of the container (and the outer wall of the core 18) has been somewhat exaggerated for purposes of illustration, particularly in order to show with clarity the positioning and functioning of the positioning straps 32 relative to the retaining device 26. Similarly, although the spacing of the coil 16 from the walls 12 has been exaggerated; nevertheless, the coil is tightly enough wound when delivered from the wire manufacturing plant, so that in fact it may tend to stand away from the walls (even though the tendency, if not kept secured in the wound condition, would be to spring out and expand against the walls 12). As the space between the core 18 and the inner hole of the coil 16 can be quite small, this also would serve to keep the tightly wound coil spaced from the walls 12.

At the bottom of the tubular core 18, a ribbon or strip 23 is glued at its ends so that it conforms a fixing loop where a lower end of an elastic band 20 can be attached, for example by means of hook 22. This elastic band exerts a downward force on a retaining rod 24 which presses down the wire retaining device 26. In a preferred embodiment of this invention, the retaining device 26 is shaped as a single ring made of metallic wire rod. It is evident that a variety of materials can be used for this ring 26. Its diameter may be selected as desired, so long as it rests on the coil top layer. While in the broader aspects of this invention, this retaining device 26 may take the form of any of a number of shapes well known in the art; however, in the preferred embodiment it is constructed as simply as possible in order to lower its cost so that it also can be easily discarded after the welding wire of the container is consumed, thus minimizing the handling of packaging elements.

The ring 26 is provided with at least one loop extension 28 (or any functional equivalent) which is fixed to said ring 26, for example by welding it to said ring, and defining an opening 30 through which a flexible ribbon or strip 32, for example made of metallic, plastic, fiber or other suitable material, is passed with the purpose of maintaining said retaining ring 26 at the top of the coiled mass 16 of welding wire 43 for preventing said welding wire 43 from unwinding through any areas other than through the central opening of said ring 26. The ring and the loop(s) should have peripheral dimensions small enough so that the ring 26 with its loop(s) 28 is not forced into constant contact with the inner walls 12 of the container (but rather can descend smoothly and easily). It is evident that the retaining member 26 may have a shape other than a ring, as long as it exerts some downward force to the upper layers of welding wire coil 16. It defines a central opening for the wire 43 to pass through, while unwinding, and it has peripheral openings 30 for ribbons 32 to pass therethrough. The upper end 33 of strips 32 are secured to an upper fixing point and their lower end 37 to a lower fixing point spanning the approximate height of the wire coil 16, by means of any suitable means, for example gluing, stapling or though any other suitable attaching means. A simple way of fixing ribbon 32 to the wall is by passing it through a hole 35 in wall 12 and gluing it to said wall 12 on its outer surface. The lower end 37 is glued between the wall 12 and flat base 14. Ribbons 32 are set loose enough to allow said ring 26 to descend by gravity as the welding wire 43 is consumed, while at the same time maintaining its function of preventing the wire from passing through the peripheral space between wall 12 and retaining device 26.

Core 18 is provided with slots 34 and 36 to permit passage of retaining rod 24 therethrough to engage and press down evenly on the retaining device ring 26 during transportation and storage of the container. Normally, slot 34 is used, but when smaller amounts of welding wire are packaged in the container, the retaining rod 24 is passed through lower slot 36 in the tubular core.

A first cover 38 is placed over lateral wall 12 and below second cover 40. This second cover 40 is provided with a central opening for positioning the guide member 42 shown in FIG. 2. Therefore, the first cover 38 is used to close the opening of the second cover 40 during transportation and storage of the container. Both covers are made of corrugated cardboard and the second cover 40 has flaps 44 provided with any fastening means 46, for example hook and loop fasteners, ("velcro®" which is a registered trademark of Velcro Industries) or other suitable adhesive means which adhere with the corresponding means (not shown) located in the wall 12 of the container. When the welding wire 43 is to be fed to welding machines, the covers 38 and 40 are then easily and rapidly removed and the guide element 42 is assembled in cover 40 which is again positioned and fixed to the wall 12 of the container.

A viewing slot 41, covered by a transparent film, is provided at the lower portion of wall 12 for inspecting the height of the wire coil. This viewing slot is useful for determining in advance the preparation and time of substitution of the nearly depleted container with a new one, and avoids numerous interruptions in the operation of welding machines.

An advantage of the container of the invention is that the guide element 42 does not form part of the container, therefore, its design, even though simple and relatively inexpensive, it can be optimized for long duration, since these guide elements do not have to be transported and are maintained at the welding plant The wire retaining device 26 of the present invention can also be advantageously utilized even in prior art drums currently used for packaging welding wire. See FIG. 4, where numerals indicate equivalent elements of the invention, which shows such typically cylindrical containers incorporating the retaining device of the invention. This type of retaining device lowers the cost of packaging and assures that the welding wire is smoothly withdrawn from the container in a simple and inexpensive manner.

A preferred embodiment of the retaining ring has three evenly distributed peripheral openings for three corresponding strips when used in cylindrical containers and in a container of octagonal section it is preferably provided with four peripheral openings. In a further alternative embodiment, the retaining device 26 can be comprised of two concentric wire rod rings 26' and 26" held together by means of radially extending rigid wire rod bridges 27, and having at least three peripheral openings 30 formed as radially projected openings.

It is to be understood that the invention has been described in detail in connection with some preferred embodiments known at the time, but that the invention is not limited to the embodiments herein described and that numerous changes, variations, substitutions or equivalent arrangements not herein described can be made therein without departing from the spirit and scope of the invention, which is defined by and only limited by the scope of the appended claims.

What is claimed is:

1. A container for packaging a welding wire coil formed by a multitude of layers of looped wire forming a generally cylindrical body of wire leaving a central cavity from which the wire can be withdrawn, said container comprising a rigid bottom portion for supporting a coil of welding wire when positioned therein;

an outer wall for enclosing and protecting the sides of a coil, said outer wall having an open upper end and a lower end fixed to said bottom portion and a height taller than the height of the coil which it is adapted to contain;

at least one strip-like tie-down member within said container having one end secured to said outer wall at an upper point located near the upper end of said outer wall and the other end secured at a lower point on said container located near said lower end of said outer wall and substantially vertically aligned with said upper point;

a vertically movable retaining device adapted to rest on top of a coil when positioned in said container and having a first inner opening for said wire to pass there-through upon being payed out from said coil when in said container, and also having at least a second, peripheral, opening through each of which a respective tie-down member passes thus cooperating with said retaining device to prevent any loop of the coil of wire from passing upwardly in the container past said retaining device other than through said first opening and from accidental entangling of said wire during unwinding from the coil.

2. A container according to claim 1, further comprising a cover fitting over the wall of said container to enclose and protect a wire coil when positioned in said container during its transportation and storage.

3. A container according to claim 2, wherein said wall and said cover are made of corrugated cardboard.

4. A container according to claim 3, wherein said wall is formed by at least two layers of corrugated cardboard, and the internal corrugations of said respective cardboard layers are orientated in different directions.

5. A container according to claim 3, further comprising a central core member defining with said outer wall an annular space for accommodating said welding wire coil, to prevent said multitude of looped wire layers from tangling by maintaining the loops of welding wire around said core in said annular space.

6. A container according to claim 5, further comprising a pressing member adapted to exert a force on said retaining device downwardly against the top of a coil when positioned within the container.

7. A container according to claim 6, further comprising a pallet-type base supporting said bottom portion of said container for its handling by frontloaders.

8. A container according to claim 7, wherein said pallet-type base is made of wood.

9. A container according to claim 7, wherein said pallet-type base is made of plastic material.

10. A container according to claim 7, wherein said pallet-type base is made of cardboard.

11. A container according to claim 7, wherein said core and said removable second cover portion are made of corrugated cardboard.

12. A container according to claim 11, further comprising a coil of welding wire positioned in said container.

13. A container according to claim 12, wherein said retaining device, sized to fit within said annular space comprises two concentric wire rod rings, held together by means of rigid wire rod radially extending bridges, and having at least three peripheral openings formed by radially projected openings.

14. A container according to claim 2, wherein said vertical wall is made of corrugated cardboard which is externally covered with a water-based resin rendering said vertical wall of said container externally water-repellent.

15. A container according to claim 14, wherein said cover has a first portion with a central opening adapted to accommodate a guide member for said wire during its unwinding from said coil and further includes a second portion in the form of a removable disk fitting within said first portion so as to close the central opening.

16. A container according to claim 15, wherein said first cover portion is provided with a plurality of lateral flaps that vertically overlap a part of said outer wall.

17. A container according to claim 16 wherein at least two of the lateral flaps are provided with fixing means which interact with corresponding fixing means on the upper outer overlapped part of said wall to keep the first cover portion in its position, including during unwinding of welding wire.

18. A container according to claim 17, wherein said fixing means are constituted by fastening means of the hook-and-loop type.

19. A container according to claim 17, wherein said fixing means are constituted by adhesive tape.

20. A container kit having component parts capable of being shipped in flattened or other compact form and of being assembled into protective packaging for storage and shipment of a welding wire coil having a multitude of layers of looped wire forming a generally cylindrical body of wire leaving a central cavity from which coil the wire can be withdrawn, the kit comprising the combination of:

a relatively flat and rigid bottom portion for supporting said coil of welding wire;

a flattened outer wall portion capable of being curled and fixed to itself along its side edges to create a tubular form with a lower end affixed to said bottom portion at its bottom edge and with an upper end and with a height taller than the height of a coil to be protectively contained therein;

at least one strip-like tie-down member of a length adapted to have one end secured to an upper point located near the upper end of said outer wall portion and the other end of said tie-down member secured to a lower point located near the lower end of said outer wall portion in a manner so as to be relatively taut and substantially vertically aligned when in the assembled form;

a vertically movable retaining device adapted to rest on and press down upon a coil positioned in said container and having a first inner opening for said wire to pass therethrough when said wire is payed out from a coil in said container, and also having at least a second, peripheral, opening through any of which a respective tie-down member is adapted to be threaded thus cooperating with said retaining device to prevent any loop of a coil of said wire from passing upwardly in the container peripherally past said retainer retaining device or otherwise other than through said first opening of said retaining device and from accidental entangling of said wire during unwinding from the coil.

21. A container kit according to claim 20, wherein the container further includes a core sized to be fixed to the bottom portion and fit within the central cavity of a coil of wire and the container including the core is made of cardboard and said wall is scored to facilitate forming into a polygonal shape upon being curled into tubular form, and further comprising a flattened cover portion having the same polygonal shape with flaps adapted to be folded down at right angles and secured each to its adjacent flap to form a container lid.

22. A container kit according to claim 21, wherein the retaining device comprises two concentric wire rod rings, held together by means of rigid wire rod radially extending bridges, and having at least three peripheral openings formed by radially projected openings.

* * * * *